US008695754B2

(12) United States Patent
Iiyama et al.

(10) Patent No.: US 8,695,754 B2
(45) Date of Patent: Apr. 15, 2014

(54) MUFFLER OF INTERNAL COMBUSTION ENGINE

(75) Inventors: Tadashi Iiyama, Shizuoka (JP); Kenji Matsushita, Shizuoka (JP)

(73) Assignee: Suzuki Motor Corporation, Shizuoka (JP)

( * ) Notice: Subject to any disclaimer, the term of this patent is extended or adjusted under 35 U.S.C. 154(b) by 2 days.

(21) Appl. No.: 13/444,078

(22) Filed: Apr. 11, 2012

(65) Prior Publication Data

US 2012/0267190 A1 Oct. 25, 2012

(30) Foreign Application Priority Data

Apr. 20, 2011 (JP) ..... 2011-093727

(51) Int. Cl.
*F01N 13/08* (2010.01)

(52) U.S. Cl.
USPC ..... 181/227; 181/228

(58) Field of Classification Search
USPC ..... 181/227, 228
See application file for complete search history.

(56) References Cited

U.S. PATENT DOCUMENTS

| | | | | |
|---|---|---|---|---|
| 2,979,357 | A * | 4/1961 | Leach et al. | 293/113 |
| 5,227,593 | A * | 7/1993 | Takahashi et al. | 181/255 |
| 5,392,602 | A * | 2/1995 | Matsumoto | 60/299 |
| 5,633,482 | A * | 5/1997 | Erion et al. | 181/282 |
| 5,718,045 | A * | 2/1998 | Tsukahara et al. | 29/890.08 |
| 5,869,793 | A * | 2/1999 | Berger et al. | 181/256 |
| 6,026,930 | A * | 2/2000 | Ogisu et al. | 181/228 |
| 6,467,570 | B1 * | 10/2002 | Herold | 181/231 |
| 6,499,561 | B1 * | 12/2002 | Yasuda | 181/227 |
| 7,464,789 | B2 * | 12/2008 | Yamamoto et al. | 181/256 |
| 7,549,510 | B2 * | 6/2009 | Sakurai et al. | 181/252 |
| 7,624,842 | B2 * | 12/2009 | Mizutani | 181/249 |
| 7,810,610 | B2 * | 10/2010 | Nishimura et al. | 181/251 |
| 2002/0134614 | A1 * | 9/2002 | Chen | 181/252 |
| 2003/0136607 | A1 | 7/2003 | Kawamata et al. | |
| 2006/0000668 | A1 * | 1/2006 | Yamaguchi et al. | 181/249 |
| 2006/0042871 | A1 * | 3/2006 | Yasuda et al. | 181/227 |
| 2006/0124384 | A1 * | 6/2006 | Tary et al. | 181/243 |
| 2007/0227808 | A1 * | 10/2007 | Sakurai et al. | 181/249 |
| 2007/0295002 | A1 | 12/2007 | Sakurai et al. | |
| 2008/0196970 | A1 * | 8/2008 | Honma et al. | 181/256 |
| 2009/0120716 | A1 * | 5/2009 | Yamamoto et al. | 181/205 |
| 2010/0243371 | A1 * | 9/2010 | Inoue | 181/227 |

FOREIGN PATENT DOCUMENTS

| | | | |
|---|---|---|---|
| JP | 52-100457 U | | 7/1977 |
| JP | 59087223 A | * | 5/1984 |
| JP | 59-110322 U | | 7/1984 |
| JP | 62-271919 A | | 11/1987 |
| JP | 02064215 A | * | 3/1990 |
| JP | 2001-182522 A | | 7/2001 |

OTHER PUBLICATIONS

An Extended European Search Report (EESR), dated Aug. 24, 2012, which issued during the prosecution of European Patent Application No. 12163891.0, which corresponds to the present application.

* cited by examiner

*Primary Examiner* — Jeremy Luks
(74) *Attorney, Agent, or Firm* — Troutman Sanders LLP

(57) ABSTRACT

A muffler of an internal combustion engine is characterized in that a muffler of an internal combustion engine having a muffler main body connected to a rear end of an exhaust pipe of the internal combustion engine, a tail pipe extended from a rear end surface of the muffler main body, and a tail cover covering an outer periphery of the tail pipe includes a partition wall compartmentalizing a space formed between the tail pipe and the tail cover into at least two or more spaces.

5 Claims, 5 Drawing Sheets

MUFFLER OF INTERNAL COMBUSTION ENGINE

CROSS-REFERENCE TO RELATED APPLICATION

This application is based upon and claims the benefit of priority of the prior Japanese Patent Application No. 2011-093727, filed on Apr. 20, 2011, the entire contents of which are incorporated herein by reference.

BACKGROUND OF THE INVENTION

1. Field of the Invention

The present invention relates to a muffler of an internal, combustion engine used for a vehicle such as a motorcycle and an automobile.

2. Description of the Related Art

Conventionally, in a vehicle such as a motorcycle and an automobile, exhaust as from an internal combustion engine is discharged to the rear of the vehicle via a muffler. The above-described muffler usually has a muffler main body forming one or a plurality of sound-deadening chamber(s) and a tail pipe extended from a rear end surface of the muffler main body. Thus, it is so constituted that the exhaust gas from the inner combustion engine passes through the noise-deadening chamber of the muffler main body and thereafter the exhaust gas is discharged from the tail pipe.

In the muffler of the above constitution, exposing the tail pipe from the rear end surface of the muffler main body is not preferable in terms of design of the vehicle. Thus, a tail cover is integrally formed with the muffler main body, in a manner to cover an outer periphery of the tail pipe. Further, there is formed a ring-like gap in which a tube is to be inserted at a time of an exhaust gas sampling inspection in a space between the tail pipe and the tale cover.

When exhaust is done by the muffler of such a constitution, pressure fluctuation occurs in the above-described gap, and concurrently therewith, air in the above-described space communicated with the cap vibrates, sometimes generating an abnormal noise called a "whistling sound". In order to suppress an occurrence of such an abnormal noise, Patent Literature 1 discloses a technique to form a discharge port end portion of the tail pipe in a manner so enlarge an inside diameter toward the outside gradually or steppedly.

[Patent Literature 1] Japanese Laid-open Patent Publication 2001-182522

However, by only performing a processing described above to the tail pipe, it is difficult to sufficiently suppress the vibration of the air occurring in the space between the tail pipe and the tail cover, and a suppressing effect of the abnormal noise occurrence is limited.

Though narrowing the gap between the tail cover and the tail pipe enables prevention of the abnormal noise occurrence, in such a case it is hard to insert a tube in the above-described gap at a time of the exhaust gas sampling inspection, and the exhaust gas sampling inspection becomes troublesome. Further, extending the tail pipe more rear than the tail cover similarly enables prevention of the occurrence of the abnormal noise, but in such a case the rear end portion of the tail pipe is exposed from the tail cover, unsatisfying demand of design.

SUMMARY OF THE INVENTION

Thus, in view of the above-described circumstances, an object of the present invention is to provide a muffler of an internal combustion engine enabling a smooth sampling inspection of exhaust gas and capable of sufficiently suppressing an occurrence of an abnormal noise such as a whistling sound while satisfying demand of design.

The present invention is characterized in that a muffler of an internal combustion engine having a muffler main body connected to a rear end of an exhaust pipe of the internal combustion engine, a tail pipe extended from a rear end surface of the muffler main body, and a tail cover covering an outer periphery or the tail pipe includes: a partition wall compartmentalizing a space formed between the tail pipe and the tail cover into at least two or more spaces.

By adopting such a constitution, it is possible to make a volume of a space affected by pressure fluctuation at an exhaust time smaller, and concurrently therewith, it becomes possible to suppress an occurrence of an abnormal noise such as a whistling sound.

Further, a rear edge portion of the tail pipe can be positioned more front than a rear edge portion of the tail cover.

By adopting such a constitution, prevention of exposure of she rear edge portion of the tail pipe from the tail cover becomes possible, enabling improvement of design of the muffler. On the other hand, if such a constitution is adopted, as a result, the rear edge portion of the tail pipe is approximated to the rear edge portion of the tail cover, and concurrently therewith, there is an apprehension that pressure fluctuation at an exhaust time becomes large. However, in the present embodiment, since a volume of the space affected by pressure fluctuation at a time of exhaust is made smaller by the partition wall, influence due to the pressure fluctuation can be reduced thereby to suppress the occurrence of the abnormal noise even if the pressure fluctuation becomes large. As stated above, the present invention is effectively applied to a constitution in which a rear edge portion of a tail pipe is disposed more from than a rear edge portion of a tail cover.

Further, one end portion of the partition wall can be supported in a cantilever state by any one of the muffler main body, the tail pipe, and the tail cover, and, in another end portion side of said partition wall, a space communication portion communicating the two or more spaces can be formed.

By adopting such a constitution, another end portion of the partition wall is not necessary to be fixed to the muffler main body, the tail pipe, or the tail cover, and concurrently therewith, precision position adjustment or welding of the above-described respective members and another end portion of the partition wall is unnecessary. Thus, it becomes possible to simplify manufacturing processes and to reduce a manufacturing cost of the muffler.

Further, the partition wall can be formed of a member different from the muffler main body, the tail pipe, and the tail cover.

By adopting such a constitution, it is possible to enlarge shape flexibility of the partition wall.

Further, the partition wall can be a pipe-shaped member compartmentalizing the space into an inner side space surrounding the tail pipe and an outer side space surrounding the inner side space.

By using the pipe-shaped member as the partition wall, a material of the partition wall can be easily obtained and the partition wall can be easily welded to the muffler main body, the tail pipe, or the tail cover.

Further, the tail cover can have a peripheral wall portion covering an outer periphery of the tail pipe, a rear wall portion extended from a rear end of the peripheral wall portion toward an inner side, and a fold portion folded from the rear wall portion toward the front, and the fold portion can be provided in a state to be inserted between the tail pipe and the partition wall in a manner to overlap with the partition wall.

By making the fold portion and the partition wall overlap with each other as above, it is possible to prevent air in the outer side space from being directly affected by pressure fluctuation, so that it becomes possible to heighten the effect of prevention of the occurrence of the abnormal noise.

Further, an external communication portion communicating the inner side space and the outside can be provided between the tail pipe and the fold portion, a space communication portion communicating the inner side space and the outer side space can be provided between the fold portion and the partition wall, and an opening area of the space communication portion can be smaller than an opening area of the external communication portion.

By adopting such a constitution, it is possible to suppress the air of the outer side space from being affected by the pressure fluctuation further effectively, so that it becomes possible to further heighten the effect of prevention of the occurrence of the abnormal noise.

DETAILED DESCRIPTION OF THE PREFERRED EMBODIMENTS

Hereinafter, first to third embodiments of the present invention will be described with reference to the drawings. Hereinafter, in each embodiment, a case in which a constitution of the present invention is applied to an on-road-type motor cycle 1 will be explained. It should be noted that directions of upper and lower, right and left, and front and rear are directions seen from a driver riding on the motorcycle 1.

First Embodiment

Figure 2:
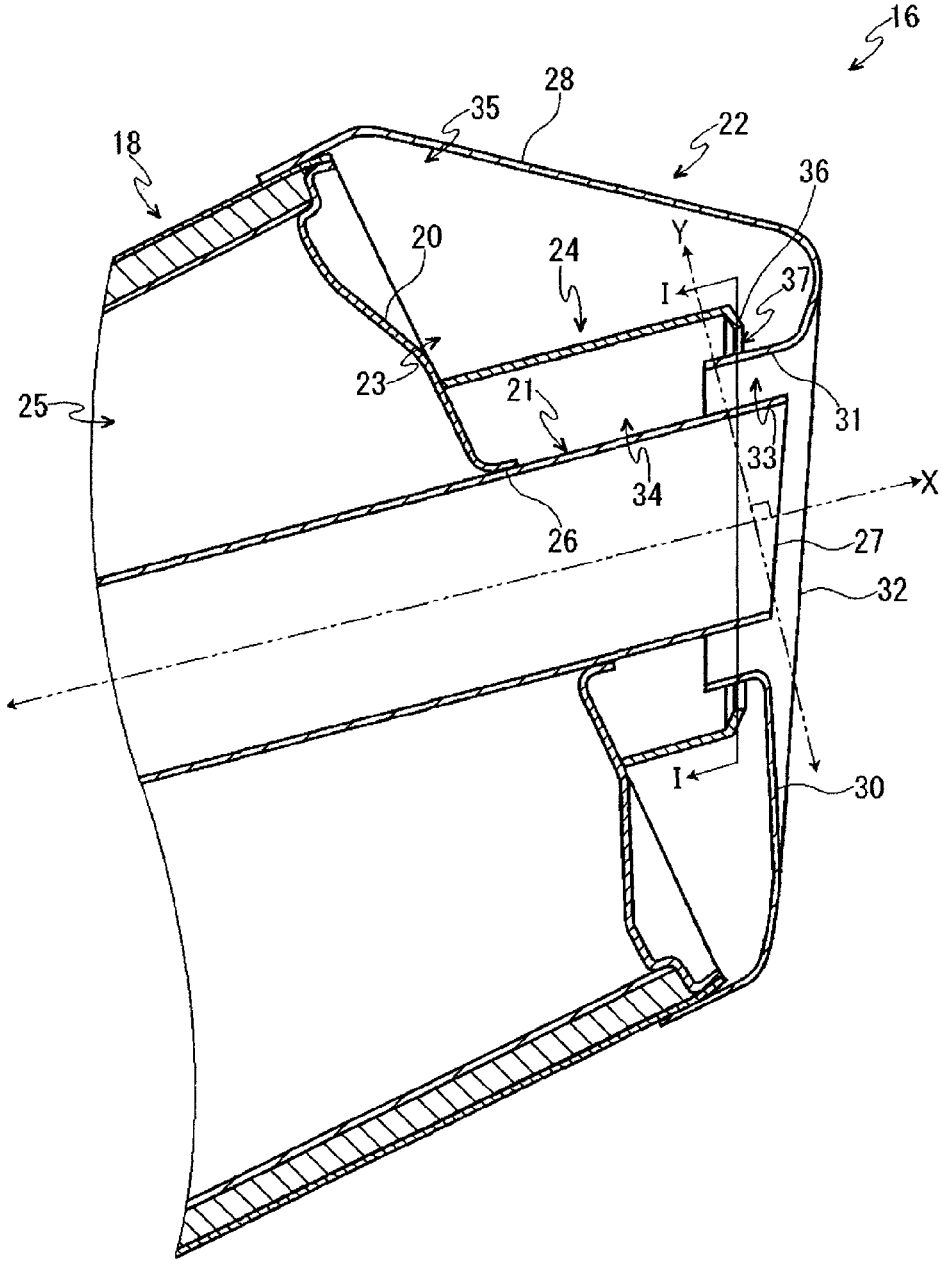
FIG. 2 is a cross-sectional view depicting an internal structure of a muffler rear portion in the motorcycle according to the first embodiment of the present invention.
Figure 3:
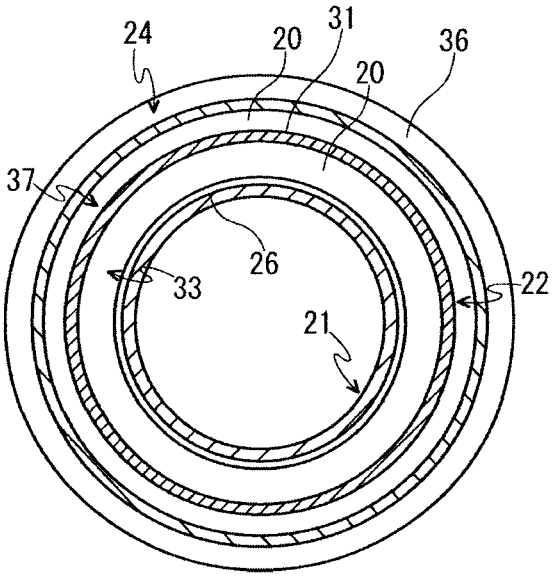
FIG. 3 is an I-I cross-sectional view of FIG. 2.

The first embodiment of the present invention will be described, with reference to FIG. 1 to FIG. 3. First, an entire constitution of the motorcycle 1 will be described by using FIG. 1.

The motorcycle 1 is provided with a vehicle body frame 2 constituting a framework. The vehicle body frame 2 is, for example, of a twin-tube type and is constituted mainly by a head pipe (not shown) disposed in a front portion upper end of the vehicle body frame 2, a right and left pair of main frames 5 extended from the head pipe to rear downward, and a right ant left pair of seat rails 6 extended from rear portions of the main frames 5 to rear upward.

A right and left pair of front forks 7 is supported by the head pipe rotatably in right and left directions. A front wheel 8 is pivotally supported by a lower end of the front fork 7, and a handle bar 9 is supported by an upper end of the front fork 7.

A fuel tank 10 is provided between the right and left pair of main frames 5, a driver's seat 11 is provided above the seat rail 6 in the rear of the fuel tank 10, and an internal combustion engine (engine) 12 is mounted below the fuel tank 10. A pivot shaft 13 is bridged in rear lower portions of the right and left pair of main frames 5, and a front end portion of a swing arm 14 is supported by the pivot, shaft 13 in a swingable manner in an upper and lower direction. A rear wheel 15 is pivotally supported by a rear end portion of the swing arm 14, and a muffler 16 is provided in right upper of the rear wheel 15. The muffler 16 is connected to an exhaust pipe 17 of the internal combustion engine 12, and it is so constituted that exhaust gas from the internal combustion engine 12 flows into the muffler 16 via the exhaust pipe 17.

Next, details of the muffler 16 will be described by using FIG. 1 to FIG. 3. It should be noted that in FIG. 2 a left side of the drawing is the front of the vehicle and a right side is the rear of the vehicle.

The muffler 16 has a muffler main body 18 connected to a rear end of the exhaust pipe 17, a tail pipe 21 extended from a rear end surface 20 of the muffler main body 18, a tail cover 22 covering an outer periphery of the tail pipe 21, and a partition wail 24 disposed in a space 23 formed between the tail pipe 21 and the tail cover 22.

Figure 1:
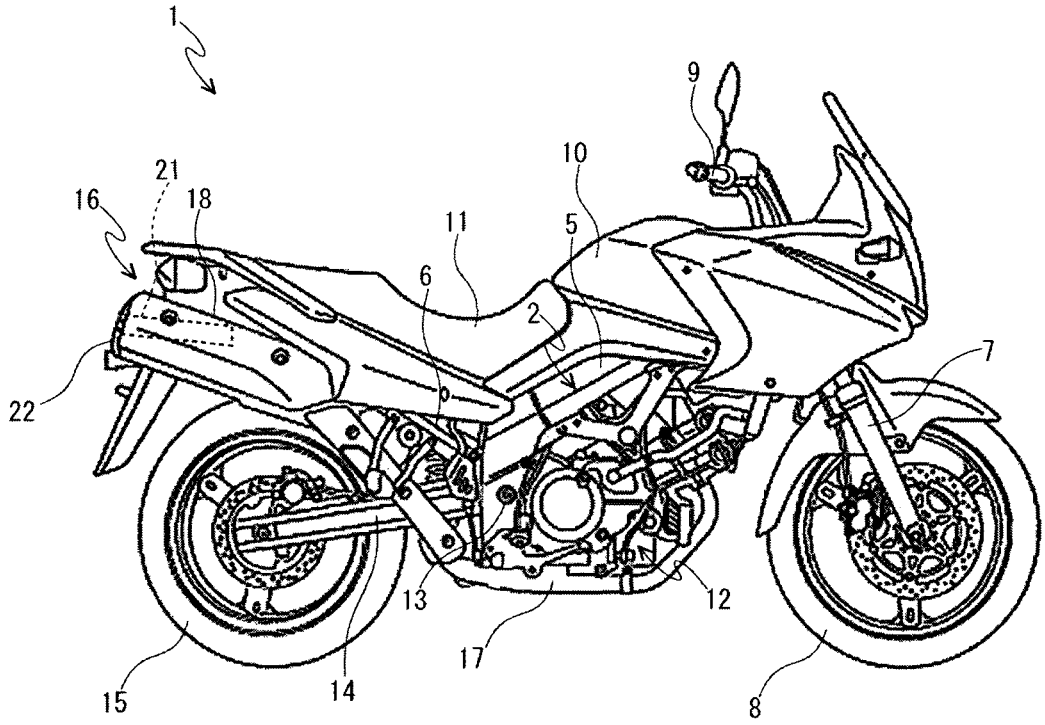
FIG. 1 is a right side view depicting a motorcycle according to a first embodiment of the present invention.

The muffler main body 18 has a shape long in a from and rear direction, and is provided in a posture inclined slightly upward toward the rear (see FIG. 1). Inside of the muffler main body 18 is divided into a plurality of sound-deadening chambers 25 by partition walls (not shown), and the plural sound-deadening chambers 25 are communicated with each other by communicating pipes (not shown). It should be noted that FIG. 2 depicts only the sound-deadening chamber 25 provided in a rear end, of the plural sound-deadening chambers 25. An insertion hole 26 is bored in a center of the rear end surface 20 of the muffler main body 18.

The tail pipe 21 has a shape long in the front and rear direction (see FIG. 1). As depicted in FIG. 2, the tail pipe 21 is inserted through the insertion hole 26 of the muffler main body 18. A front end portion of the tail pipe 21 is communicated with any one (for example, the sound-deadening chamber 25 second from the rear) of the plural sound-deadening chamber 25, while a rear end portion of the tail pipe 21 opens toward the outside (rear) of the muffler 16. It is so constituted that after exhaust gas flowing from the exhaust pipe 17 of the internal combustion chamber 12 to the muffler main body 18 sequentially passes the plural sound-deadening chambers 25, the exhaust gas is discharged toward the rear of the muffler 16 via the tail pipe 21. A rear edge portion 27 of the tail pipe 21 is provided in a manner to be inclined slightly forward toward down.

The tail cover 22 has a peripheral wall portion 28 covering an outer periphery of the tail pipe 21, a rear wall portion 30 extended from a rear end of the peripheral, wall, portion 28 toward an inner side, and a fold portion 31 folded from an upper portion of the rear wall portion 30 to the front. The peripheral wall portion 28 has a cylindrical shape and protrudes from a rear end portion of the muffler main body 18 to rear downward. A front end portion of the peripheral wall portion 28 is connected to the rear end portion of the muffler main body 18.

Around a boundary of the peripheral wall portion 28 and the rear wall portion 30, a rear edge portion 32 of the tail cover 22 is formed almost in parallel with the rear edge portion 27 of the tail pipe 21. In the present embodiment, disposition of respective members is adjusted in a manner that the rear edge portion 27 of the tail pipe 21 is positioned more front than the rear edge portion 32 of the tail cover 22.

The fold portion 31 has a cylindrical shape, and faces the rear end portion of the tail pipe 21 via a predetermined interval. Between the fold portion 31 and the rear end portion of the tail pipe 21 is formed an external communication portion 33 of a ring shape, and a tube is to be inserted to the external communication portion 33 at a time of a sampling inspection of exhaust gas.

The partition wall 24 is formed of a member different from the muffler main body 18, the tail pipe 21, and the tail cover 22. The partition wall 24 is a pipe-shaped member compartmentalizing the space 23 into an inner side space 34 surrounding the tail pipe 21 and an outer side space 35 surrounding the inner side space 34, and the tail pipe 21 and the partition wail 24 form a double-pipe shape (see FIG. 3).

A front end portion of the partition wall 24 is welded to the rear end surface 20 of the muffler main body 18, and thereby, the partition wall 24 is supported by the muffler main body 18 in a cantilever state. The partition wall 24 is provided close to the tail pipe 21 so that a volume of the inner side space 34 becomes smaller than a volume of the outer side space 35.

In a rear end portion of the partition wall 24, a bent portion 36 is provided toward an inner side, a space communication portion 37 of a ring shape is formed between the bent portion 36 and the fold portion 31, and the inner side space 34 and the outer side space 35 are communicated with each other via the space communication portion 37. As depicted in FIG. 3, in the present embodiment, an opening area (area of a ring-shaped portion) of the space communication portion 37 is smaller than an opening area (area of a ring-shape portion) of the external communication portion 33.

The rear end portion of the partition wall 24 is disposed to overlap with the fold portion 31 in a direction Y (see FIG. 2) orthogonal to a longitudinal direction X of the tail pipe 21. In other words, the fold portion 31 is provided in a state to be inserted between the rear end portion of the tail pipe 21 and the rear end portion of the partition wall 24.

In a thing constituted as above, when the internal combustion engine 12 drives, exhaust gas from the exhaust pipe 17 flows into the muffler main body 16, passes through the respective sound-deadening chambers 25, and thereafter, is discharged from the tail pipe 21 to the outside. Then, by a pressure concurrent with the discharge, pressure fluctuation occurs around the external communication portion 33. However, in the present embodiment, since the space 23 is compartmentalized into the inner side space 34 and the outer side space 35 by the partition wall 24, it is possible to make a volume of the space affected by the above-described pressure fluctuation smaller. Concurrently therewith, it becomes possible to prevent an occurrence of an abnormal noise such as a whistling sound.

Further, by providing the partition wall 24 in such a space 23, an occurrence of an abnormal noise is prevented, and thus narrowing a width of the external communication portion 33 for the sake of prevention of an occurrence of an abnormal noise is not necessary. Therefore, it is possible to prevent an occurrence of a problem that a tube is hard to be inserted in an external communication portion 33 because a width of the external communication portion 33 is too narrow at a time of a sampling inspection of exhaust gas, so that it becomes possible to perform a sampling inspection of exhaust gas smoothly.

Further, in the present embodiment, since the rear edge portion 27 of the tail pipe 21 is positioned more front than the rear edge portion 32 of the tail cover 22, prevention of exposure of the rear edge portion 27 of the tail pipe 21 from the tail cover 22 becomes possible, enabling improvement of design of the muffler 16.

On the other hand, if such a constitution is adopted, as a result, the rear edge portion 27 of the tail pipe 21 is approximated to the rear edge portion 32 of the tail cover, and concurrently therewith, there is an apprehension that pressure fluctuation occurring around the external communication portion 33 at an exhaust time becomes large. However, in the present embodiment, since a volume of the space affected by pressure fluctuation at a time of exhaust is made smaller by the partition wall 24, influence due to the pressure fluctuation can be reduced thereby no suppress an occurrence of an abnormal noise even if the pressure fluctuation occurring around the external communication portion 33 becomes large. As stated above, the present invention is effectively applied to a constitution in which a rear edge portion 27 of a tail pipe 21 is disposed more front than a rear edge portion 32 of a tail cover 22.

Further, in the present embodiment, since the front end portion of the partition wall 24 is supported in the cantilever state by the rear end surface 20 of the muffler main body 18, the rear end portion of the partition wall 24 is not necessary to be fixed to the muffler main body 18, the tail pipe 21, or the tail cover 22. Concurrently therewith, precision position adjustment or welding of the above-described respective members and the partition wall 24 is unnecessary. Thus, it becomes possible to simplify manufacturing processes and to reduce a manufacturing cost of the muffler 16.

On the other hand, if the partition wall 24 is supported by the muffler 18 in the cantilever state, the rear end portion of the partition wall 24 becomes a free end, and the space communication portion 37 between the inner side space 34 and the outer side space 35 is formed in a rear end portion side of the partition wail 24. Therefore, not only air of the inner side space 34 but also air of the outer side space 35 are slightly affected by pressure fluctuation around the external communication portion 33. However, in the present embodiment, the partition wall 24 is provided close to the tail pipe 21 so that the volume of the inner side space 34 which is easy to be affected by pressure fluctuation becomes smaller than the volume of the outer side space 35 which is hard to be affected by the pressure fluctuation. Therefore, even if the space communication portion 37 is formed, influence due to pressure fluctuation can be reduced, and it becomes possible to heighten a suppression effect of an abnormal noise occurrence.

Further, since the partition wall 24 is formed of the member different from the muffler main body 18, the tail pipe 21, and the tail cover 22, it is possible to enlarge shape flexibility of the partition wall 24. Further, since the partition wall 24 is a pipe-shaped member, a material of the partition wall 24 can be easily obtained and the partition wall 24 can be easily welded to the muffler main body 18.

Further, since the partition wall 24 is disposed to overlap with the fold portion 31 in the direction Y orthogonal to the longitudinal direction X of the tail pipe 21, it is possible to prevent air in the outer side space 35 from being directly affected by pressure fluctuation around the external communication portion 33, so that in becomes possible to heighten the effect of prevention of the occurrence of the abnormal noise.

Further, in the present embodiment, since the opening area of the space communication portion 37 is smaller than the opening area of the external communication portion 33, it is possible to suppress the air of the outer side space 35 from being affected by the pressure fluctuation around the external communication portion 33 further effectively, so that it becomes possible to further heighten the effect of prevention of the occurrence of the abnormal noise.

Second Embodiment

Figure 4:
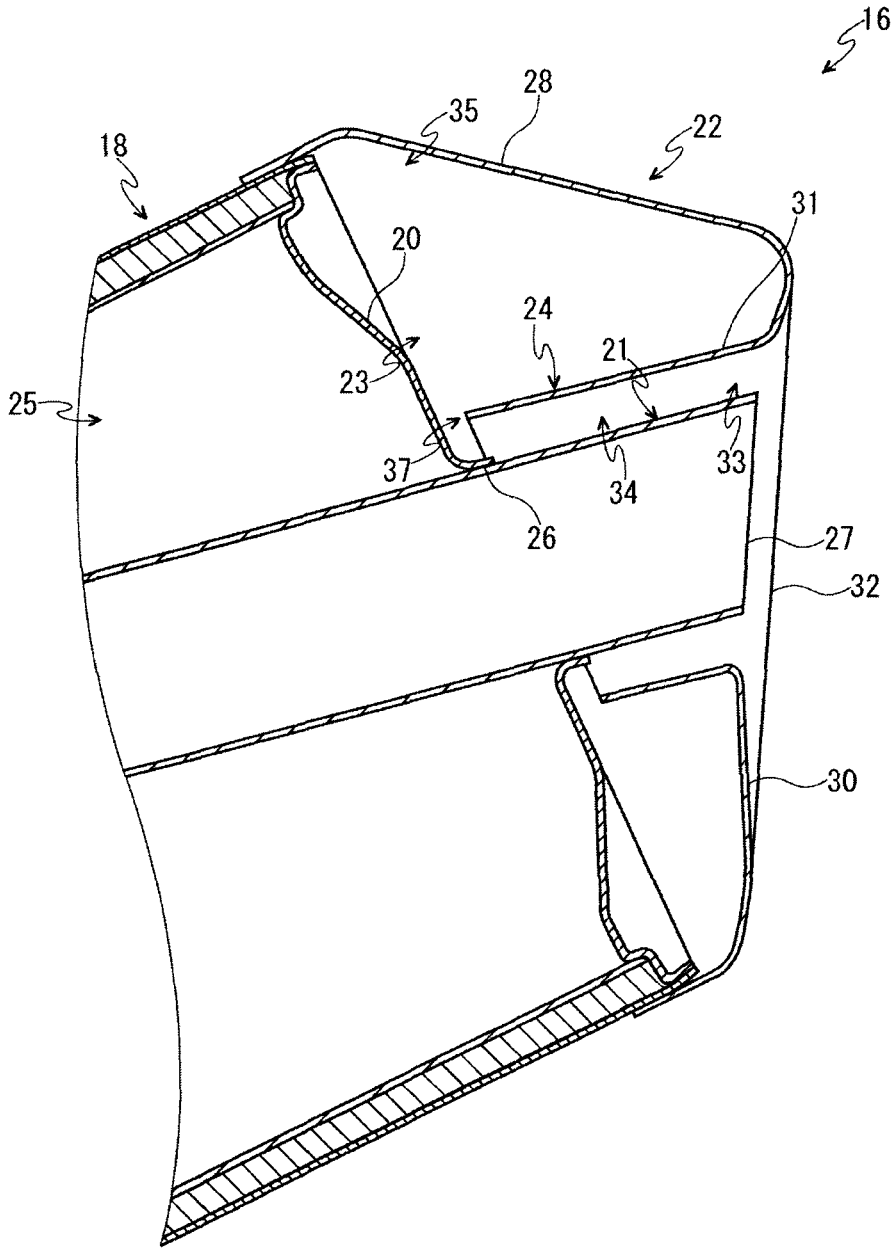
FIG. 4 is a cross-sectional view depicting an internal structure of a muffler rear portion in a motor cycle according to a second embodiment of the present invention.

Next, the second embodiment of the present invention will be described by using FIG. 4. It should be noted that since constitutions of members except a tail cover 22 and a partition wall 24 are similar to those in the first embodiment, explanation thereof will be omitted.

The tail cover 22 has a peripheral wall portion 28 covering an outer periphery of a tail pipe 21, a rear wall portion 30 extended from a rear end of the peripheral wall portion 23 toward an inner side, and a fold portion 31 folded from an upper portion of the rear wall portion 30 toward the front, and a partition wall 24 is integrally formed with the fold portion 31 in a manner to be extended from the fold portion 31 toward the front. Between a front end portion of the partition wall 24 and a rear end surface 20 of the muffler main body 18 is provided a space communication portion 37 communicating an inner side space 34 and an outer side space 35.

In the present embodiment, since the partition wall 24 is integrally formed with the tail cover 22 as described above, a component number can be reduced compared with a case in which a partition wall 24 is formed independently of a tail cover 22 as in the first embodiment. Concurrently therewith, it becomes possible to reduce a manufacturing cost.

Third Embodiment

Figure 5:
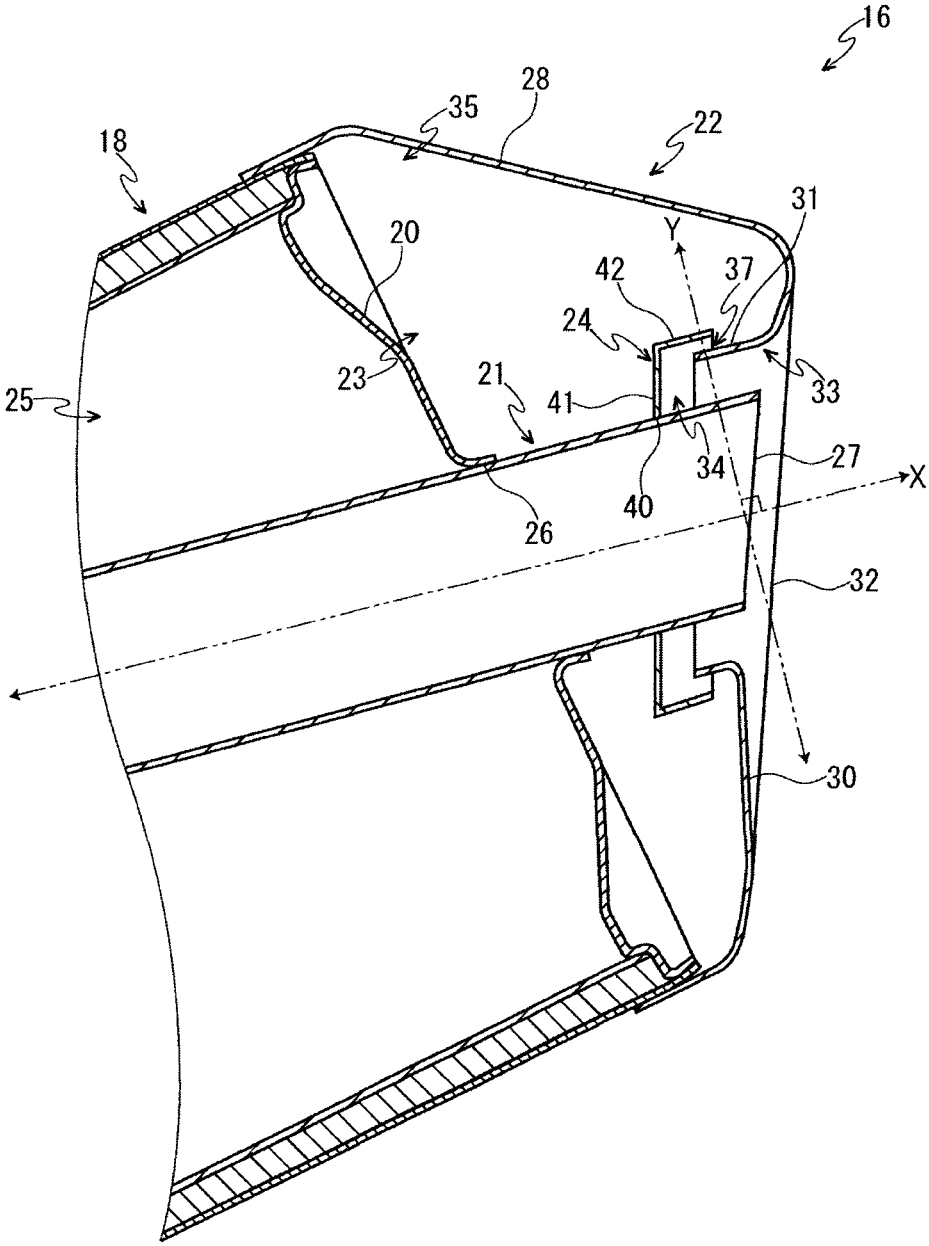
FIG. 5 is a cross-sectional view depicting an internal structure of a muffler rear portion in a motorcycle of a third embodiment of the present invention.

Next, the third embodiment of the present invention will be described by using FIG. 5. It should be noted that since constitutions of members except a partition wall 24 are similar to those in the first embodiment, explanation thereof will be omitted.

The partition wall 24 has a mounting plate 41 having a through hole 40 bored in a center and having a ring shape, and a flange 42 protruding from an outer periphery of the mounting plate 41 toward the rear. An inner periphery part of the through hole 40 of the mounting plate 41 is welded to an outer peripheral surface of the tail pipe 21. The flange 42 is disposed to overlap with a fold portion 31 in a direction Y orthogonal to a longitudinal, direction X of a tail pipe 21. In other words, the fold portion 31 is provided in a state to be inserted between the tail pipe 21 and the flange 42.

As described above, by welding the mounting plate 41 of the partition wall 24 to the outer peripheral surface of the tail pipe 21, it is possible to make a volume of an inner side space 34 easy to be affected by pressure fluctuation further smaller, compared with a case in which a partition wall 24 is welded to a rear end surface 20 of a muffler main body 18 as in the first embodiment. Concurrently therewith, it becomes possible to further heighten a suppression effect of an abnormal noise.

In the first to third embodiments, cases in which the space communication portion 37 is formed between the inner side space 34 and the outer side space 35 are explained, but in another different embodiment, an inner side space 34 and an outer side space 35 can be completely compartmentalized, without a space communication portion 37 being provided. In this case, while there is, an apprehension that welding processes are increased or position adjustment becomes complicated, the outer side space 35 can be surely prevented from being affected by pressure fluctuation around an external communication portion 33, so that an effect of preventing an occurrence of an abnormal sound can be further heightened.

In the first to third embodiments, though cases in which the space 23 is compartmentalized into the inner side space 34 and the outer side space 35 are explained, a method for compartmentalizing the space 23 is not limited thereto. For example, in another different embodiment, a space 23 can be compartmentalized into a front side space and a rear side space by protruding a partition wall 24 from an inner surface of a peripheral wall portion 28 of a tail cover 22 in parallel with a direction Y (see FIG. 2) orthogonal to a longitudinal direction X of a tail pipe 21.

In the first to third embodiment, though cases in which the space 23 is compartmentalized into two spaces of the inner side space 34 and the outer side space 35 are explained, in another embodiment, a space 23 can be compartmentalized into three or more spaces by providing a plurality of partition walls 24.

In the first to third embodiments, though cases of using the tail cover 22 of the constitution where the rear wall portion 30 is protruded toward the inside from the rear end portion of the peripheral wall portion 28 are explained, in another different embodiment, the present invention can be applied to a cylindrical tail, cover 22 in which a rear wall portion 30 does not exist and an entire rear surface of a peripheral wall portion 28 is opened.

In the first to third embodiments, though cases in which the present invention is applied to the on-road-type motorcycle are explained, in another different embodiment, the present invention can be applied so a motorcycle 1 of a different type such as an off-road type and a scooter. Further, in still another different embodiment, the present invention can be applied to a vehicle other than a motorcycle 1, such as an automobile, for example.

According to the present invention, it becomes possible to provide a muffler of an internal combustion engine enabling a smooth sampling inspection of exhaust gas and capable of sufficiently suppressing an occurrence of an abnormal noise such as a whistling sound while satisfying demand of design.

It should be noted that the above embodiments merely illustrate concrete examples of implementing the present invention, and the technical scope of the present invention is not to be construed in a restrictive manner by these embodiments. That is, the present invention may be implemented in various forms without departing from the technical spirit or main features thereof.

What is claimed is:

1. A muffler of an internal combustion engine having a muffler main body connected to a rear end of an exhaust pipe of the internal combustion engine, a tail pipe extended from a rear end surface of the muffler main body, and a tail cover covering an outer periphery of the tail pipe, the muffler of the combustion engine comprising:

a partition wall compartmentalizing a space formed between the tail pipe and the tail cover into at least two or more spaces, wherein said partition wall is a pipe-shaped member compartmentalizing the space into an inner side space surrounding the tail pipe and an outer side space surrounding the inner side space, wherein the tail cover comprises a peripheral wall portion covering an outer periphery of the tail pipe, a rear wall portion extended from a rear end of the peripheral wall portion toward an inner side, and a fold portion folded from the rear wall portion toward the front, and wherein said fold portion is provided in a state to be inserted between the tail pipe and said partition wall in a manner to overlap with said partition wall.

2. The muffler of the internal combustion engine according to claim 1, wherein a rear edge portion of the tail pipe is positioned more front than a rear edge portion of the tail cover.

3. The muffler of the internal combustion engine according to claim 1, wherein one end portion of said partition wall is supported in a cantilever state by any one of the muffler main body, the tail pipe, and the tail cover, and wherein in another end portion side of said partition wall, a space communication portion communicating the two or more spaces is formed.

4. The muffler of the internal combustion engine according to claim 1, wherein said partition wall is formed of a member different from the muffler main body, the tail pipe, and the tail cover.

5. The muffler of the internal combustion engine according to claim 1, wherein an external communication portion communicating the inner side space and the outside is provided between the tail pipe and said fold portion, wherein a space communication portion communicating the inner side space and the outer side space is provided between said fold portion and said partition wall, and wherein an opening area of the space communication portion is smaller than an opening area of the external communication portion.

* * * * *